United States Patent [19]

Bremmer

[11] 4,331,549

[45] May 25, 1982

[54] HYDRAULIC FLUIDS CONTAINING CYANO DERIVATIVES OF KETONES

[75] Inventor: Bart J. Bremmer, Ashland, Mass.

[73] Assignee: The Dow Chemical Company, Midland, Mich.

[21] Appl. No.: 142,514

[22] Filed: Apr. 21, 1980

[51] Int. Cl.[3] ..... C10M 3/26

[52] U.S. Cl. ..... 252/77; 260/465.1

[58] Field of Search ..... 252/77; 260/465.1

[56] References Cited

U.S. PATENT DOCUMENTS

| | | | |
|---|---|---|---|
| 2,850,519 | 9/1958 | Krimm | 260/465.1 X |
| 3,538,003 | 11/1970 | Lothar | 252/77 |
| 3,779,930 | 12/1973 | Alcorn et al. | 252/77 |
| 3,780,082 | 12/1973 | Deumens et al. | 260/465.1 |
| 3,816,503 | 6/1974 | Poelvoorde et al. | 260/465.1 X |
| 3,931,278 | 1/1976 | Muller | 260/465.1 |
| 4,093,554 | 6/1978 | Jayne et al. | 252/78.3 |
| 4,218,472 | 8/1980 | Joensson et al. | 424/316 |

*Primary Examiner*—Harris A. Pitlick

*Attorney, Agent, or Firm*—Douglas N. Deline

[57] ABSTRACT

Hydraulic fluids having high wet equilibrium reflux boiling points, good chemical stability and other desirable characteristics comprise certain cyano-substituted compounds of the formula

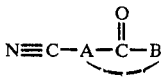

wherein A and B are specified radicals.

8 Claims, No Drawings

HYDRAULIC FLUIDS CONTAINING CYANO DERIVATIVES OF KETONES

BACKGROUND OF THE INVENTION

This invention relates to hydraulic fluids which maintain high wet equilibrium reflux boiling points on exposure to or contamination with moisture. The fluids are used in devices operated by fluid pressure, such as hydraulic brakes, clutches, fluid transmissions, shock absorbers, power steering and control devices for aircraft, ships, automobiles and other vehicles, artillery recoil mechanisms, door checks, jacks and other hydraulic devices adapted for transfer of mechanical energy.

A hydraulic fluid adapted for the above uses must meet a variety of requirements. It should be chemically stable, nearly nonvolatile, and of low flammability, and yet should remain a homogeneous flowable liquid at temperatures as low as −40° C. Additionally, a hydraulic fluid is subject to moisture contamination which may arise because of the inherent hygroscopicity of the hydraulic fluid, from condensation of moisture from the air, or from physical leakage or defects in the hydraulic system that permits water to enter. The deleterious effects arising from moisture contamination of hydraulic fluids include lowering of boiling points, vapor locking, corrosion, hydrolysis, foaming, sludging, freezing, ice crystallization and the like.

Requirements to be met for a satisfactory hydraulic fluid particularly a hydraulic fluid used in motor vehicle hydraulic braking systems have been established by the United States National Highway Safety Bureau and are known generally as DOT 3, DOT 4, and DOT 5 (DOT referring to the Department of Transportation). Included therein are different requirements to be met by proposed hydraulic fluids such as: wet and dry equilibrium reflux boiling point (ERBP), wet and dry viscosity at −40° C., chemical stability and rubber compatibility standards, etc. A hydraulic fluid satisfying the different testing standards is characterized as being a DOT 3-, DOT 4-, or DOT 5-fluid depending on the particular standard that is met or exceeded by the fluid. Details of this testing procedure are published in the Federal Motor Vehicle Safety Standard, 49 CFR §571.116.

SUMMARY OF THE INVENTION

It has been discovered that hydraulic fluids having good physical characteristics are provided by fluids containing as components thereof cyano-containing compounds of from 3 to 20 carbons of the formula:

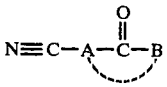

(I)

wherein

A is a divalent radical of from 1 to 10 carbons selected from branched or linear alkylene and

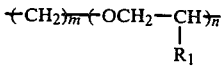

wherein $R_1$ is hydrogen, methyl or ethyl and m and n are integers equal to or greater than 1; and B is a monovalent radical of from 1 to 10 carbons selected from branched or linear alkyl, and cyano-, hydroxy-, or oxyalkyl-substituted derivatives thereof. The dotted lines indicate optional joinder of A and B.

The cyano-substituted compounds of the invention have been found to possess desirable qualities making them suited for use in hydraulic fluid formulations. In particular the compounds exhibit high wet equilibrium reflux boiling points as well as low viscosities at −40° C. and good rubber swelling characteristics. The compounds including mixtures thereof may be combined in major or minor proportion with other hydraulic fluid components and/or additives into hydraulic fluid formulations having qualities tailored for specific applications.

DETAILED DESCRIPTION OF THE INVENTION

The cyano-substituted compounds for use according to this invention are known. Methods for their production are also known. Their manufacture by the reaction of various ketones and acrylonitrile has been described in U.S. Pat. Nos. 2,850,519; 3,780,082; 3,816,503 and 3,931,278 and other references.

Preferred cyano-substituted compounds of formula I for use as hydraulic fluids are cyano-substituted ketones of from 4 to 10 carbons. A most preferred cyano-substituted compound is 5-oxohexane nitrile.

As is well-known in the art, suitable qualities for a hydraulic fluid are rarely found in one compound. However, a composition comprising several suitable compounds may be formulated to produce a hydraulic fluid composition having satisfactory properties.

In particular the low viscosities but high boiling points of the present compounds, particularly 5-oxohexane nitrile, make such compounds well suited for use as a diluent in a hydraulic fluid composition. Depending on the choice of remaining compounds combined in the hydraulic fluid the amount of cyano-substituted ketone according to formula I present in a hydraulic fluid may vary over a wide range and still provide a hydraulic fluid meeting or exceeding DOT 4 requirements.

Preferred are compositions employing from about 5 percent to about 90 percent by weight of the cyano-substituted ketone, the remainder comprising hydraulic fluid components and/or additives.

By the term "hydraulic fluid component" or simply "component" is meant a solid or liquid chemical compound which when employed as an ingredient in a hydraulic fluid is not substantially chemically reactive with other components or additives or with the cyano-substituted compounds of the invention and which is substantially immune to decomposition or reaction under the hydraulic fluid operating conditions to which it is exposed and the mechanical systems with which it comes into contact. Particular properties such as boiling point, viscosity, etc., may vary depending on the application for which the hydraulic fluid is used and the operating conditions to which it is exposed. Selection of particular components and mixtures thereof to meet various design criteria may easily be determined by the skilled artisan.

By the term "hydraulic fluid additive" or simply "additive" is meant a solid or liquid chemical compound usually added in a small amount to a hydraulic fluid composition to control or modify various chemical or physical properties of the components of the hydraulic fluid.

Preferred hydraulic fluid components for the instant invention may be selected from conventionally known components such as: glycols, glycol ethers including formals, glycol esters, glycol orthoesters, borate esters, etc.

Specifically, the glycols include (poly)alkylene glycols of the formula $HO\text{-}(R'O)_n\text{-}H$ wherein each R' is the same or different and is a linear or branched $C_{1-6}$ alkylene and n is a positive number up to about 10. Such (poly)alkylene glycol hydraulic fluid components are well-known in the art.

The polyglycol ethers and formals known as conventional hydraulic fluid components include compounds of the formula $R'_1O\text{-}(R'O)_n\text{-}R_2$ and $[R_2O\text{-}(R'O)_n\text{-}]_2CH_2$ wherein R' and n are as previously defined, $R'_1$ is a $C_{1-4}$ linear or branched alkyl, hydrogen or phenyl radical, and $R_2$ is a $C_{1-4}$ linear or branched alkyl or phenyl radical.

The glycol ester conventional hydraulic fluid components include compounds of the formula

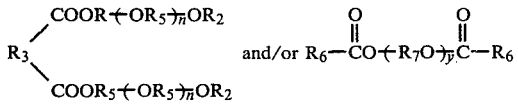

wherein n and $R_2$ are as previously defined, $R_3$ is a straight- or branched-chain alkylene group containing at least 2, preferably 2 to 8, carbon atoms, each $R_5$ is the same or different and is an alkylene radical containing from 2 to 4 carbon atoms, each $R_6$ is the same or different and is a methyl or ethyl group, each $R_7$ is the same or different and is an ethylene or propylene group and y is an integer from 1 to 8, preferably an integer such that the total number of carbon atoms in the $\text{-}(R_7O)\text{-}$ group is from 4 to 12.

Glycol ortho ester hydraulic fluid components known and used in conventional fluids are such glycol ortho esters of the formula

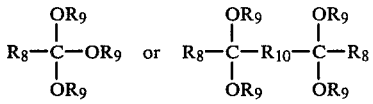

wherein each $R_8$ is a hydrogen atom, an alkyl radical containing from 1 to 5 carbon atoms, or the same as $R_9$; each $R_9$ is the same or different and each is an alkyl radical containing from 1 to 4 carbon atoms, an oxyalkylene glycol monoether radical, or a polyoxyalkylene glycol monoether radical containing from 2 to 20 alkylene oxyunits; and $R_{10}$ is an alkylene radical containing from 1 to 12 carbon atoms.

Numerous varieties of borate ester hydraulic fluid components are known. These may be depicted by the following formulas:

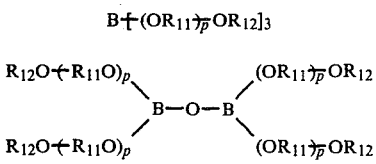

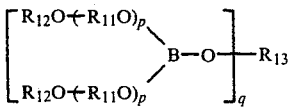

-continued

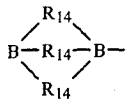

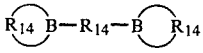

wherein each $R_{11}$ is the same or different and is a straight or branched $C_{2-4}$ alkylene group, each $R_{12}$ is the same or different and is hydrogen or a $C_{1-4}$ alkyl group, each p is the same or different and is an integer, q is an integer of from 2 to 6, $R_{13}$ is the residue of a di- or polyhydroxy organic compound having a number of reactive hydroxy groups equal to q, and each $R_{14}$ is the same or different and is the residue of a dihydroxy organic compound which residue is attached to each boron atom via an oxygen atom.

A mixture of such borate ester compounds together with compounds containing reactive hydroxyl functionality generally results by means of alkoxide exchange in production of an equilibrium mixture of such compounds in the resulting hydraulic fluid.

The foregoing list of known conventional hydraulic fluid components are more fully described in U.S. Pat. No. 4,093,554 to which reference may be made for further details.

Particularly preferred conventional hydraulic fluid components are (poly)alkylene glycols.

Among the various types of additives which can be added to the hydraulic fluids of this invention are included: inhibitors for pH and corrosion control, antioxidants, lubricity agents, antifoamants, stabilizers, demulsifiers, dyes and odor suppressants. Generally, the total amount of additives which may be incorporated into the fluid composition will vary depending on the particular composition and the desired properties.

As conventionally used additives of hydraulic fluids in order to inhibit oxidation of the organic compounds at high temperatures may be named the antioxidants diarylamines, e.g., diphenylamine, p,p'-dioctyldiphenylamine, phenyl-α-naphthylamine, or phenyl-β-naphthylamine. Other suitable anitoxidants are those commonly known as hindered phenols exemplified by:

2,4-dimethyl-6-t-butyl phenol
2,6-ditertiarybutyl-4-methyl phenol
2,6-di-t-butyl phenol
1,1-bis(3,5-di-t-butyl-4-hydroxyphenyl)methane
3,3',5,5-tetra-t-butyl-4,4'-dihydroxydiphenyl-3-methyl-4,6-di-t-butyl phenol
4-methyl-2-t-butyl phenol Yet further additives which may be used are phenothiazine and its derivatives, for example those having alkyl, or aryl groups attached to the nitrogen atom or to the aryl groups of the molecule.

Conventional lubricity additives usefully added to hydraulic fluids include high molecular weight monoethers of polyalkylene glycols, for example, such monoalkyl ethers of polypropylene glycol of 500 or higher molecular weight; mineral oil; and castor oil derivatives, e.g., blown castor oil (castor oil blown with air or oxygen while being heated), castor oil treated with ethylene oxide or propylene oxide.

Other lubricity additives conventionally known include borate esters, e.g., tricresyl borate and borate ester condensates; and phosphorus-containing esters, especially phosphates, e.g., tricresyl phosphate.

Other lubricity agents are orthophosphate or sulfate salts of primary or secondary aliphatic amines having a total of from 4 to 24 carbon atoms, dialkyl citrates having an average of from 3.5 to 13 carbon atoms in the alkyl groups, aliphatic dicarboxylic acids and esters thereof, specific examples being diamylamine orthophosphate
dinonylamine orthophosphate
diamylamine sulfate
dinonyl citrate
di(2-ethyl hexyl)citrate
polyoxyethylene sebacate derived from a polyoxyethylene glycol of M.W. 200
polyoxyethylene azelate derived from a polyoxyethylene glycol of M.W. 200
polyoxyethylene adipate derived from a polyoxyethylene glycol of M.W. 200
polyoxyethylene/polyoxypropylene glutarate derived from mixed polyoxyglycols of average M.W. of about 200
diethyl sebacate
di-2-ethyl hexyl sebacate
diisooctyl azelate Corrosion inhibitors which may be used in the present invention may be selected from heterocyclic nitrogen-containing compounds, e.g., benzotriazole and benzotriazole derivatives or mercapto benzothiazole. Many amines or derivatives thereof are also suitable as corrosion inhibitors, for example:

di-n-butylamine
di-n-amylamine
cyclohexylamine
morpholine
triethanolamine
and soluble salts thereof, e.g., cyclohexylamine carbonate.

Phosphites are also good corrosion inhibitors, e.g.:

triphenyl phosphite
diisopropyl phosphite and certain inorganic salts may be incorporated, e.g., sodium nitrate.

The preceding list of known conventional additives for hydraulic fluids are more fully described in U.S. Pat. No. 4,093,554 to which reference may be made for further details.

The various compounds, cyano-substituted compounds of formula I, components and additives, are formulated into the invented hydraulic fluid by adding the compounds in any order and agitating the resulting mixture until a uniform, homogeneous composition results. Heating to a slightly elevated temperature may be employed as an aid in formulation of the invented hydraulic fluid.

SPECIFIC EMBODIMENTS

The following examples illustrate various embodiments of the present invention, but the present invention should not be construed to be limited thereto.

EXAMPLES 1-3

The following hydraulic fluid formulations were prepared for testing according to Federal Motor Vehicle Safety Standard No. 116, 49 CFR §571.116 (amended 1974). Results of the testing are contained in Table 1.

| Example | Hydraulic Fluid Composition | |
|---|---|---|
| 1 | 5-oxohexane nitrile - | 99 + % |
| 2 | 2-(2-cyanoethyl)cyclohexanone - | 99 + % |
| 3 | 5-oxohexane nitrile - | 54% |
| | DOWANOL TMH[a] - | 12% |
| | Borate ester[b] - | 32% |
| | Corrosion and oxidation inhibitors - | 1.5% |
| | Lubricity additive - | 0.1% |

[a]Triethylene glycol monomethyl ether and higher glycol ethers.
[b]Prepared by reacting 15 parts by weight diethylene glycol, 16 parts by weight DOWANOL TMH and 4.72 parts by weight boric acid (60% borate ester) and removing water formed by the reaction.

TABLE I

| | ERBP °C. | | Viscosity −40° C. (cst.) | | Rubber Cup Swelling (mm) | Rubber Cup −Δ hardness IRHD | Stability Δ °C. | |
|---|---|---|---|---|---|---|---|---|
| Fluid | Dry | Wet | Dry | Wet | | | Chemical | Thermal |
| Ex. 1 | 236 | 159 | 33.7 | 34.3 | 0.23 | 7 | 1.7 | 2.8 |
| Ex. 2 | — | 215 | 2993 | — | 2.10 | 15 | — | — |
| Ex. 3 | — | 170 | — | 433 | 0.20 | 6 | — | — |
| DOT 4 | 230 | 155 | 1800 max. | 1800 max. | 1.4 max. | 15 max. | 3.0 max. | 3.0 max. |

What is claimed is:

1. A hydraulic fluid comprising (I) from 5 percent to 90 percent of one or more cyano-substituted compounds of from 3 to 20 carbons of the formula

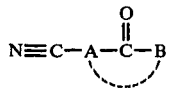

wherein:

A is a divalent radical of from 2 to 10 carbons selected from branched or linear alkylene and

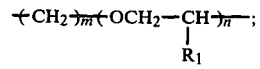

wherein $R_1$ is each occurrence hydrogen, methyl or ethyl and m and n are integers equal to or greater than 1;

B is a monovalent radical of from 1 to 10 carbons selected from branched or linear alkyl and cyano-, hydroxy-, or oxyalkyl-substituted derivatives thereof; and

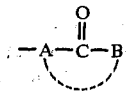

furthermore may optionally be oxocycloalkyl, and (II) from 95 percent to 10 percent of a remainder component selected from conventional hydraulic fluid components, additives or mixtures thereof.

2. A hydraulic fluid composition meeting or exceeding DOT 4 requirements according to claim 1.

3. A hydraulic fluid composition as claimed in claim 1 wherein the conventional hydraulic fluid component is selected from:

(1) a polyalkylene glycol of the formula HO—R-'O)$_n$H wherein R' is each occurrence the same or different and is a linear or branched $C_{1-6}$ alkylene and n is a positive number up to about 10;

(2) a polyglycol ether or polyglycol formal of the formula $R'_1O—R'O—)_nR_2$ and $[R_2O—R-'O)_n]_2CH_2$ wherein R' and n are as previously defined, $R'_1$ is hydrogen, $C_{1-4}$ linear or branched alkyl or phenyl, and $R_2$ is $C_{1-4}$ linear or branched alkyl or phenyl;

(3) a glycol ester of the formula

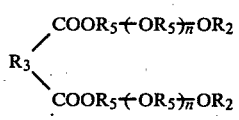

or

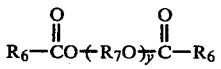

wherein n and $R_2$ are as previously defined, $R_3$ is straight or branched $C_{2-8}$ alkylene, $R_5$ is each occurrence the same or different and is $C_{2-4}$ alkylene, $R_6$ is each occurrence $C_{1-2}$ alkyl, $R_7$ is each occurrence $C_{2-3}$ alkylene and y is an integer from 1 to 8;

(4) a glycol orthoester of the formula

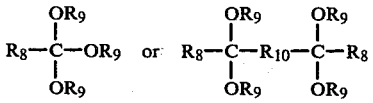

wherein $R_8$ is each occurrence hydrogen, $C_{1-5}$ alkyl or $R_9$, $R_9$ is each occurrence $C_{1-4}$ alkyl, an oxyalkylene glycol monoether radical or polyoxyalkylene glycol monoether radical of from 2 to 20 oxyalkylene units, and $R_{10}$ is $C_{1-12}$ alkylene;

(5) a borate ester of the formula

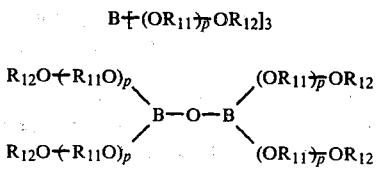

-continued

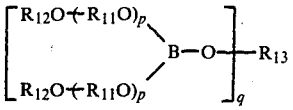

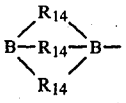

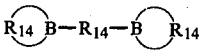

wheren $R_{11}$ is each occurrence straight or branched $C_{2-4}$ alkylene, $R_{12}$ is each occurrence hydrogen or $C_{1-4}$ alkyl, p is each occurrence an integer, q is an integer from 2 to 6, $R_{13}$ is the residue of a di- or polyhydroxy organic compound having a number of reactive hydroxy groups equal to q, and $R_{14}$ is each occurrence the residue of a dihydroxy organic compound which residue is attached to each boron atom via an oxygen atom; and (6) mixtures thereof.

4. A hydraulic fluid composition as claimed in claim 3 wherein the conventional hydraulic fluid component is a (poly)alkylene glycol or a mixture thereof.

5. A hydraulic fluid as claimed in claims 1, 3 or 4 wherein the cyano-substituted compound is 5-oxohexane nitrile.

6. In the operation of a fluid pressure operating device which uses hydraulic pressure transmission fluid, the improvement comprising using as said hydraulic pressure transmission fluid a fluid comprising one or more cyano-substituted compounds of from 3 to 20 carbons of the formula

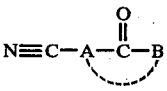

wherein:

A is a divalent radical of from 2 to 10 carbons selected from branched or linear alkylene and

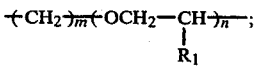

wherein $R_1$ is each occurrence hydrogen, methyl or ethyl and m and n are integers equal to or greater than 1;

B is a monovalent radical of from 1 to 10 carbons selected from branched or linear alkyl and cyano-, hydroxy-, or oxyalkyl-substituted derivatives thereof, and

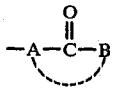

furthermore may optionally be oxocycloalkyl.

7. The improvement according to claim 6 wherein the hydraulic pressure transmission fluid is a composition as claimed in claim 1.

8. The improvement according to claim 7 wherein the cyano-substituted compound is 5-oxohexane nitrile.

* * * * *

UNITED STATES PATENT AND TRADEMARK OFFICE

CERTIFICATE OF CORRECTION

PATENT NO. : 4,331,549

DATED : May 25, 1982

INVENTOR(S) : Bart J. Bremmer

It is certified that error appears in the above—identified patent and that said Letters Patent is hereby corrected as shown below:

Column 3, line 20, that portion of the formula reading "$COOR\{OR_5\}_nOR_2$" should read -- $COOR_5\{OR_5\}_nOR_2$ --.

Column 4, line 4, that portion of the formula reading "$B-R_{14}-B-$" should read -- $B-R_{14}-B$ --.

Column 4, line 44, "suitable anitoxidants" should read -- suitable antioxidants --.

Column 4, line 50, "3,3',5,5-tetra" should read -- 3,3',5,5'-tetra --.

Column 7, line 17, that portion of the formula reading "$HO-R-$" should read -- $HO\{R-$ --.

Column 7, line 22, that portion of the formula reading "$R'_1O-R'O-)_nR_2$ and $[R_2O-R-$" should read -- $R'_1O\{R'O-)_nR_2$ and $[R_2O\{R-$ --.

UNITED STATES PATENT AND TRADEMARK OFFICE

CERTIFICATE OF CORRECTION

PATENT NO. : 4,331,549

DATED : May 25, 1982

INVENTOR(S) : Bart J. Bremmer

It is certified that error appears in the above—identified patent and that said Letters Patent is hereby corrected as shown below:

Column 8, line 9, that portion of the formula reading "$B-R_{14}-B-$" should read -- $B-R_{14}-B$ --.

Signed and Sealed this

*Eleventh* Day of *January 1983*

[SEAL]

*Attest:*

GERALD J. MOSSINGHOFF

*Attesting Officer*

*Commissioner of Patents and Trademarks*